US005207599A

United States Patent [19]

Chung

[11] Patent Number: 5,207,599

[45] Date of Patent: May 4, 1993

[54] STRUCTURE OF AN ELECTRIC SOCKET

[76] Inventor: Chien-Lin Chung, Suite 1, 11F, No. 95-8 Chang Ping Rd. Sec. 1, Taichung, Taiwan

[21] Appl. No.: 904,691

[22] Filed: Jun. 26, 1992

[51] Int. Cl.[5] ..... H01R 25/00

[52] U.S. Cl. ..... 439/650; 439/840

[58] Field of Search ..... 439/840, 841, 816, 819-821, 439/650, 833, 839

[56] References Cited

U.S. PATENT DOCUMENTS

| | | | |
|---|---|---|---|
| 1,678,745 | 7/1928 | Schellinger | 439/819 |
| 3,383,647 | 5/1968 | Duffield et al. | 439/840 |

FOREIGN PATENT DOCUMENTS

| | | | |
|---|---|---|---|
| 0760253 | 8/1980 | U.S.S.R. | 439/841 |
| 1343480 | 10/1987 | U.S.S.R. | 439/841 |
| 1450128 | 9/1976 | United Kingdom | 439/841 |

*Primary Examiner*—David L. Pirlot

[57] ABSTRACT

An electric socket comprises an insulative housing having two cavities formed therein, an elongate generally pantile shaped terminal plate in each cavity, and a helical spring element secured snugly against each terminal plate. The prongs of an electrical plug can be inserted between the terminal plates and spring elements in respective cavities, wherein the blade type prongs are firmly wedged between associated spring elements and terminal plates so as to be in reliable electrical communication therewith. The housing can be further provided with a third, central cavity having a similar spring element disposed therein and a grounding plate of conforming curvature secured to a lower portion of the spring element. An additional rod type prong on an electrical plug can be inserted into the central cavity between adjacent turns of the spring element whose pitch distance is less than the diameter of the prong and received through a cooperating aperture on the grounding plate.

6 Claims, 5 Drawing Sheets

STRUCTURE OF AN ELECTRIC SOCKET

BACKGROUND OF THE PRESENT INVENTION

The present invention relates to an electric socket, and more particularly to an electric socket wherein the prongs of a plug inserted therein are received through or between cooperating terminal plates and helical spring elements.

More conventional electric sockets of the prior art generally employ stamped metal terminal plates secured within an insulative housing which are flexed by the wedging action of the prongs of a plug when inserted therein. Though being quite functional, there is a tendency for the terminal plates to deform after repeated insertions and retractions which is often increased by the ohmic heating inherent in the device's operation. Further, the alignment of the conductors within the housing of the connector can also alter over time due to the stresses exerted on the conductors during normal usage which is compounded by the tolerances of assembly and manufacture.

It was in light of these and other deficiencies of the electrical sockets of the prior art that the present invention was accomplished, wherein an electrical connector of novel structure is provided with resilient, conductive spring elements which act in cooperation with the terminal plates thereof to engage the prongs of an electric socket, so as to provide a reliable and dependable electrical connection which can also accommodate varying types of plug structures.

SUMMARY OF THE PRESENT INVENTION

An electric socket in accordance with the present invention comprises an insulative housing having two or more cavities formed therein, a terminal plate disposed in each cavity, and a corresponding conductive helical spring element snugly secured against each terminal plate. Whereby, an electric plug can be engaged with the socket so as to insert each prong thereon into a cooperating cavity of the housing, with the prongs being firmly wedged between associated resilient spring elements and terminal plates to provide reliable electrical communication therewith. Further provision is made for an alternate form of engagement between the conductive members and a prong of the plug, in addition to or in lieu of the former, wherein the cooperating prong is held between adjacent turns of a helical spring element having a pitch distance less than the width of the prong with the terminal end portion thereon passing through an aperture on a lower terminal plate in contact therewith.

It is thus a main object of the present invention to provide an electric socket as characterized having increased reliability and sturdiness which maintains excellent electrical communication between a connected electrical device and a power mains. A further object of the present invention is to provide an electric socket having greater versatility which can accommodate several types of plug structures thereon.

More particular objects and further advantages of the present invention will become readily by apparent by reference to a detailed description of the preferred embodiments thereof, provided below along with accompanying drawings.

DETAILED DESCRIPTION OF THE PREFERRED EMBODIMENTS

Figure 1:
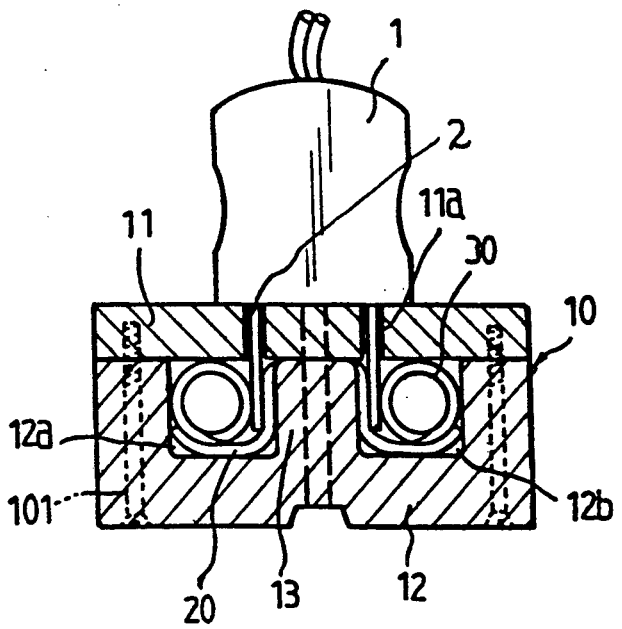
FIG. 1 is a sectional view of a first embodiment of an electric socket of the present invention with a two prong plug inserted therein.
Figure 2:
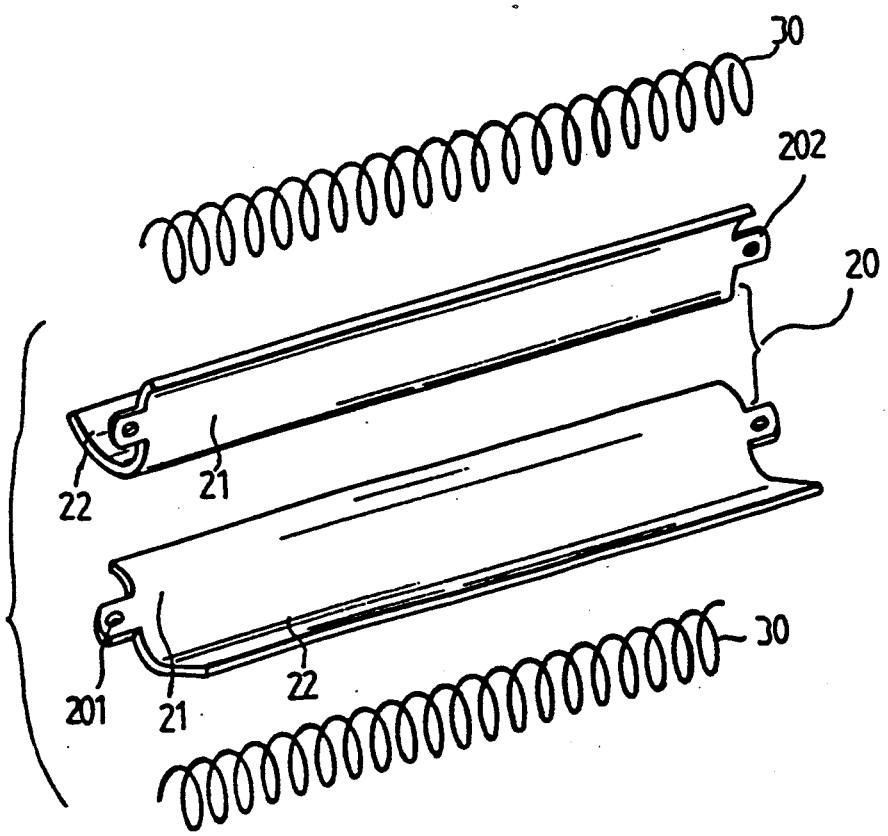
FIG. 2 is a perspective view of the elongate terminal plates and spring elements of the electric socket.
Figure 3:
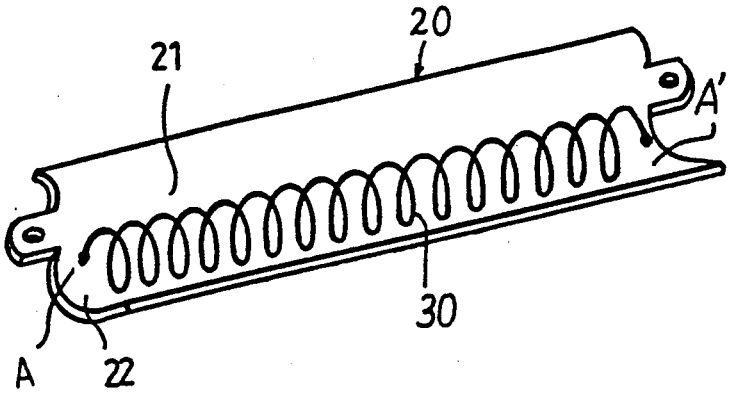
FIG. 3 is a perspective view of a terminal plate with a spring element secured thereon.

Referring to FIGS. 1 to 3 of the drawings, a first embodiment of an electric socket comprises an insulative housing 10, generally pantile shaped terminal plates 20 disposed in respective cavities 12*a*,12*b* therein, and corresponding helical spring elements 30, preferably of a copper based alloy of suitable elastic characteristic, disposed adjacent the terminal plates 20 within the cavities. The housing 10 includes an upper shell 11 having a pair of slots formed vertically therethrough and a lower shell 12 containing the cavities 12*a*,12*b* which are separated by a central wall 13. Threaded fasteners 101 releasably secure together upper shell 11 with lower shell 12. A conventional two wire plug 1 having a pair of blade type prongs 2 is engaged with the socket wherein the prongs 2 thereof are inserted through respective slots 11*a* in upper shell 11. A through hole 10*a* formed vertically through the upper and lower shells 11 and 12 allows the insertion of a three prong plug having a rod type grounding prong though there is no provision for an electrical connection therewith.

As shown in FIG. 2, elongate terminal plates 20 each have vertical portions 21 which are substantially aligned with the direction of insertion of plug 1 when disposed within the corresponding cavities of the housing, and a transverse portion 22 extending in a generally lateral direction with respect to the vertical portion. The arcuate transverse portions have a curvature conforming substantially with that of the outer periphery of spring elements 30 so as to positionable thereagainst. FIG. 3 shows a spring element 30 so disposed on a terminal plate 20 wherein the terminal ends of the spring are welded to the plate at A and A' thereon.

The terminal plates 20 with spring elements 30 so attached are placed in respective cavities of the lower shell 12 and secured to the inner end portions thereof by threaded fasteners engaged through protruding tabs 201, 202 on respective longitudinal ends of the terminal plates. Vertical portions 21 are adjacent opposing sides of the central wall 13 and transverse portions 22 assume a lower position adjacent the base of the associated cavities. Each slot on upper shell 11 is aligned over a respective cavity 12*a*,12*b* so that the prongs 2 of plug 1 are insertable between corresponding vertical portions 21 of the terminal plates and associated spring elements 30, with the axis of spring elements 30 being perpendicularly oriented with respect to the direction of insertion of the prongs. An inflected terminal edge 211 on each vertical portion serves as a further guide for the intromission of the blade prongs. The insertion of prongs 2 between the terminal plates and spring elements effect a resilient displacement of the latter in contact therewith wherein at least one turn of an associated helical spring element 30 is pressed against a corresponding side of each blade prong. The reaction force exerted by the spring elements thus ensures that the prongs 2 are firmly wedged against the corresponding terminal plates 20. The spring elements 30 which are in firm contact with an opposing side of the prongs so as to be electrical communication therewith, as well as with the associated terminal plates, provides a further conductance path to ensure a reliable operation. In addition, the relatively small area of contact between the turns of the helical spring elements and the engagement surfaces on the prongs, which entail concomitantly higher force concentrations, provides for a more efficient wiping function as compared with more conventional sockets relying solely on generally planar contact terminals.

Figure 4:
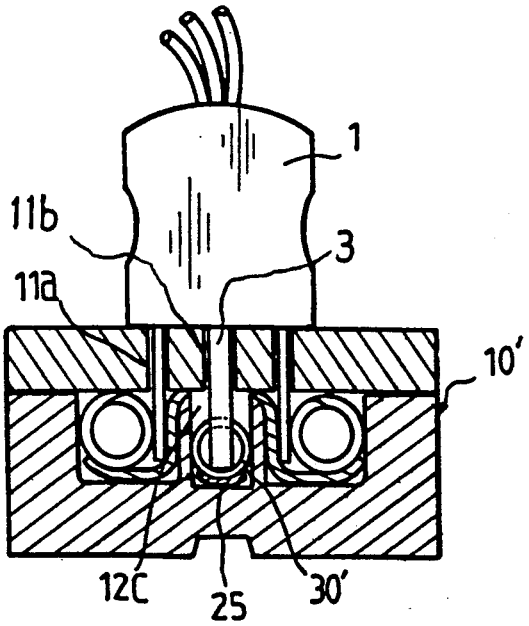
FIG. 4 is a sectional view of a second embodiment of an electric socket of the present invention with a three prong plug inserted therein.
Figure 5:
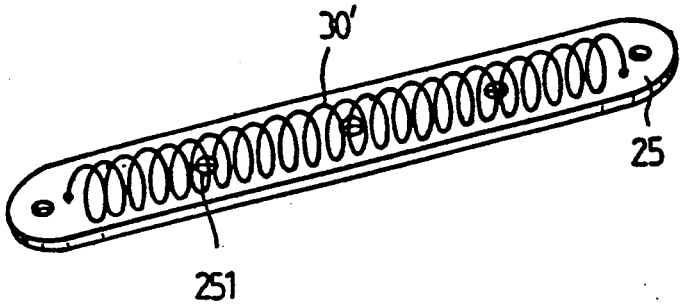
FIG. 5 is a perspective view of a grounding plate with a spring element secured thereon.
Figure 6:
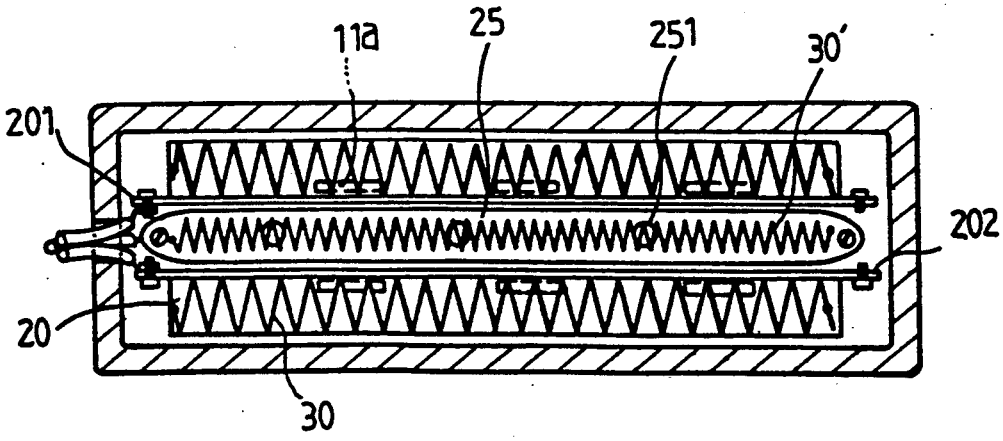
FIG. 6 is a plan view of the socket of FIG. 4 showing the internal arrangement of the members therein.

A second embodiment of an electric socket is shown in FIGS. 4 and 6, wherein a third, central cavity 12*c* is formed within the lower shell of a housing 10′ along the position of the central wall in the housing of the prior embodiment. As shown in FIG. 5, a lesser diameter helical spring element 30′ of finer pitch than the former spring element is similarly secured to an elongate grounding plate 25 having a curvate section substantially conforming in curvature with the lower portion of spring element 30′ with which it is in abutment. Grounding plate 25 and spring element 30′ are positioned within the central cavity and similarly secured therein by threaded fasteners passing through securing holes 25*a*,25*b* on the end portions of the former. The grounding prong 3 of plug 4, which is offset from a central position between the blade prongs thereon, is insertable through a through hole 11*b* in the upper shell of housing 10′ into cavity 12*c* wherein the rod type prong passes through the spring element 30′. As the pitch distance of the helical spring element is less than the width of prong 3, adjacent turns thereon are resiliently displaced in a longitudinal direction by the passage of the prong and are firmly in abutment therewith. The terminal end portion of the prong is received by a corresponding aperture 251 on the grounding plate having a substantially equal diameter therewith.

Figure 7:
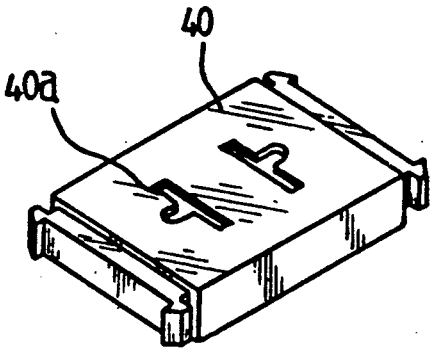
FIG. 7 is a perspective view of a modular type socket in accordance with a third embodiment.
Figure 8:
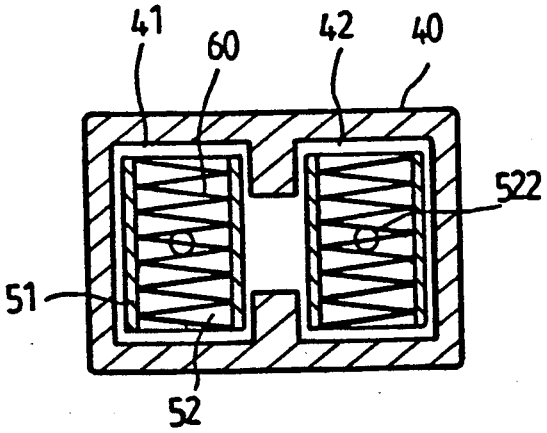
FIG. 8 is a plan view of the socket of FIG. 7 showing the internal arrangement of the members therein.
Figure 9:
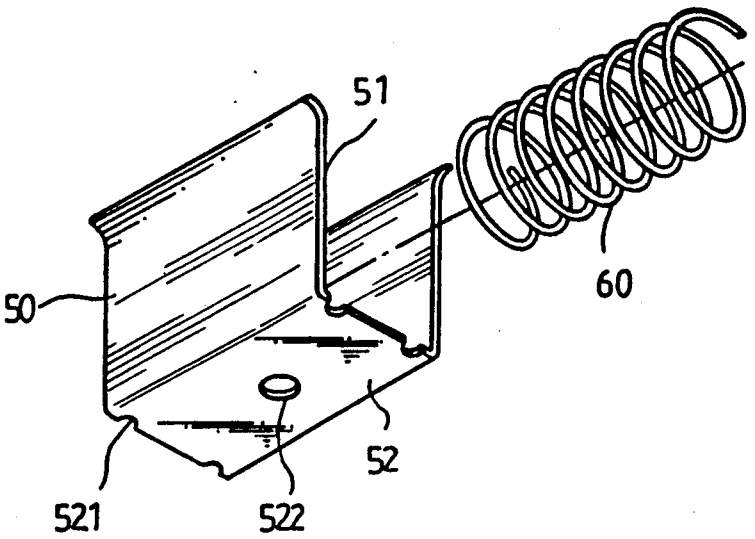
FIG. 9 is a perspective view of a terminal plate and spring element employed in the latter embodiment.

FIG. 7 and 8 show a third embodiment of an electric socket that can accommodate both electric plugs having blade type prongs and those having rod type prongs. The socket housing 40 is of a modular form and has a pair of roughly T-shaped apertures 40*a* formed thereon for the insertion of rod type prongs or blade type prongs. The housing is similarly divided into two internal cavities 41, 42 for receiving roughly U-shaped terminal plates 50. As shown in FIGS. 9 and 10, terminal plates 50 each have a pair of parallel side walls 51 and an adjoining lower wall 52 perpendicular therewith. Four notches 521 are formed adjacent the terminal edges on the lower wall near respective corners thereof. A threaded fastener is engaged through each notch 521 to secure the terminal plate to the base of a corresponding cavity. A receiving hole 522 is formed on the lower wall of each terminal plate for receiving the end portion of a rod type prong. A helical spring element 60 is disposed in each terminal plate between the side walls 51 thereof, with the axis of the spring element being parallel therewith and with lower wall 52.

It should be noted that the aforedescribed embodiments and the specificities relating thereto should not be construed in a limitative sense regarding the scope of the present invention but rather as being exemplary, with the actual spirit and scope of the present invention being determined from the appended claims and their legal equivalents.

I claim:

1. An electric socket for engagement with an electric plug comprising:

an insulative housing having at least two cavities formed therein, said housing having apertures for the passage of a plurality of prongs of said electrical plug formed at predetermined positions thereon, each aperture being in communication with a respective cavity;

a terminal plate disposed in each said cavity, said terminal plate having a vertical portion substantially aligned with a direction of insertion of a prong in an associated cavity of said housing and a transverse portion adjoined with said vertical portion of said terminal plate and disposed in a lower portion of the associated cavity;

a conductive helical spring element positioned against each said terminal plate in an associated cavity of said housing, and being in electrical communication with said terminal plate, with the axis of said spring element being substantially perpendicularly oriented with respect to the direction of insertion of one said prong, said spring element having its turns in abutment with the vertical portion of said terminal plate; and said terminal plate generally pantile shaped with the vertical portion thereof having an inflected terminal edge for guiding the insertion of a prong, and the transverse portion being of arcuate section of a curvature substantially equal with that of said spring element in abutment with said transverse portion of said terminal plate;

whereby, upon an insertion of a prong of said plug into a corresponding cavity through an associated aperture of said housing, the prong is firmly wedged between said spring element and the vertical portion of said terminal plate for an electrical connection between said prong and said terminal plate.

2. An electrical socket for engagement with an electric plug comprising:

an insulative housing having at least two cavities formed therein, said housing having apertures for the passage of a plurality of prongs of said electrical plug formed at predetermined positions thereon, each aperture being in communication with a respective cavity;

a terminal plate disposed in each said cavity, said terminal plate having a vertical portion and a transverse portion adjoined therewith and disposed in a lower portion of an associated cavity of said housing;

a conductive helical spring element positioned against each said terminal plate in an associated cavity of said housing, and being in electrical communication with said terminal plate, with the axis of said spring element being substantially perpendicularly oriented with respect to a direction of insertion of one said prong, any two adjacent turns of said spring element having a pitch distance substantially less than a width of a prong for an insertion of said prong into said turns of said spring element; and said terminal plate generally pantile shaped with the vertical portion thereof having an inflected terminal edge for guiding the insertion of said prong, and the transverse portion being of arcuate section of a curvature substantially equal with that of said spring element in abutment with said transverse portion of said terminal plate;

whereby upon an insertion of a prong of said plug into a corresponding cavity through an associated aperture of said housing, the prong is firmly wedged between adjacent turns of said spring element for an electrical communication between said prong and said terminal plate.

3. An electric socket according to claim 2 wherein the transverse portion of said terminal plate has at least an aperture formed at predetermined position thereon for receiving a lower end of a prong of said plug.

4. An electric socket for engagement with an electric plug comprising:

an insulative housing having at least two cavities formed therein, said housing having apertures for the passage of a plurality of prongs of said electrical plug formed at predetermined positions thereon, each aperture being in communication with a respective cavity;

a generally U shaped terminal plate disposed in each said cavity, said terminal plate having a pair of substantially parallel side walls and a lower wall adjoined perpendicularly therewith, a first side wall of said terminal plate being substantially aligned with a direction of insertion of a prong in the associated cavity;

a conductive helical spring element positioned against each said terminal plate in an associated cavity of said housing, and being in electrical communication with said terminal plate, with the axis of said spring element being substantially parallel with the side walls and lower wall of said terminal plate, any two adjacent turns of said spring element having a pitch distance substantially less than a width of a first type prong for an insertion of said prong into said turns of said spring element;

whereby upon an insertion of said first type prong of said plug into a corresponding cavity through an associated aperture of said housing, the prong is firmly wedged between adjacent turns of said spring element for an electrical communication between said first type prong and said terminal plate; and upon an insertion of a second type prong of said plug into a corresponding cavity through an associated aperture of said housing, the prong is firmly wedged between said spring element and the first side wall of said terminal plate for an electrical communication between said second type prong and said terminal plate.

5. An electric socket according to claim 4, wherein each said aperture on said housing is generally T shaped.

6. An electric socket according to claim 4, wherein the lower wall of said terminal plate has an aperture formed at a predetermined position thereon for receiving a lower end of a first type prong.

* * * * *